US010039333B2

(12) United States Patent
Hamilton et al.

(10) Patent No.: US 10,039,333 B2
(45) Date of Patent: Aug. 7, 2018

(54) PROTECTIVE GEAR

(71) Applicants: Shane Brian Hamilton, Glen Burnie, MD (US); Nathan Alexander Olson, Edgewater, MD (US); Matthew Arnold Olson, Edgewater, MD (US)

(72) Inventors: Shane Brian Hamilton, Glen Burnie, MD (US); Nathan Alexander Olson, Edgewater, MD (US); Matthew Arnold Olson, Edgewater, MD (US)

( * ) Notice: Subject to any disclaimer, the term of this patent is extended or adjusted under 35 U.S.C. 154(b) by 0 days.

(21) Appl. No.: 15/680,310

(22) Filed: Aug. 18, 2017

(65) Prior Publication Data

US 2017/0360121 A1 Dec. 21, 2017

(51) Int. Cl.
*A41D 13/01* (2006.01)
*A41D 13/11* (2006.01)
(Continued)

(52) U.S. Cl.
CPC ..... *A41D 13/01* (2013.01); *A41D 13/1107* (2013.01); *A41D 13/1161* (2013.01); *A41D 27/20* (2013.01); *A41D 27/28* (2013.01); *F21L 4/02* (2013.01); *F21V 17/10* (2013.01); *F21V 23/0414* (2013.01); *F21V 33/0008* (2013.01); *F21Y 2115/10* (2016.08)

(58) Field of Classification Search
None
See application file for complete search history.

(56) References Cited

U.S. PATENT DOCUMENTS 4,300,240 A * 11/1981 Edwards ..... A41D 13/1161 2/206
4,641,379 A * 2/1987 Martin ..... A41D 13/1161 128/206.28

(Continued)

OTHER PUBLICATIONS

Wrong Gear, Inc. website, www.wronggear.com.

*Primary Examiner* — Britt D Hanley
(74) *Attorney, Agent, or Firm* — Shane Brian Hamilton

(57) ABSTRACT

Protective gear for a user having an inner panel and an outer panel that is configured so the user can use: only the outer panel; only the inner panel; or both panels together. This allows the user to launder, change and/or replace either panel, without sacrificing the utility of the other panel. The outer panel and the inner panel are temporarily attached to one another when used together. The outer panel's top edge along the user's nose and below the eyes is reinforced with a pliable material, allowing the user to form the top edge of the outer panel to the user's nose and face. There is a small gap in the reinforcements at the nose area, which allows the protective gear to be folded and stored. Both the inner panel and outer panel are formed to cover the user's nose and to accommodate the eye protection worn by the user. The protective gear is configured to give flexibility to the user by allowing the user to choose: (i) an outer panel with pockets for storing items; (ii) to incorporate lights on the outside of the outer panel, allowing the user to be more visible; (iii) to incorporate a flashlight on the outside of the outer panel; (iv) inner and outer panels with access to the user's mouth for drinking, smoking or vaping, without removing the protec- (Continued)

tive gear; and (v) venting through the outer panel that is aesthetically pleasing to the user.

20 Claims, 9 Drawing Sheets

(51) Int. Cl.

| | |
|---|---|
| ***A41D 27/28*** | (2006.01) |
| ***A41D 27/20*** | (2006.01) |
| ***F21L 4/02*** | (2006.01) |
| ***F21V 23/04*** | (2006.01) |
| ***F21V 33/00*** | (2006.01) |
| ***F21V 17/10*** | (2006.01) |
| *F21Y 115/10* | (2016.01) |

(56) References Cited

U.S. PATENT DOCUMENTS 4,718,123 A * 1/1988 Petropoulos ..... A41D 23/00 2/91
4,825,474 A * 5/1989 Edwards ..... A41D 13/1161 2/206
4,924,362 A * 5/1990 Janko ..... A01K 27/006 362/108
5,025,508 A * 6/1991 Duncan ..... A41D 23/00 2/207
5,035,006 A * 7/1991 Hetz ..... A41D 13/1161 128/206.19
5,224,772 A 7/1993 Fustos
D369,442 S * 4/1996 Jones ..... D2/500
5,628,308 A * 5/1997 Harges, Jr. ..... A41D 13/1153 128/201.25
6,032,292 A * 3/2000 Wood ..... A41D 23/00 2/206
6,226,799 B1 * 5/2001 Lane ..... A41D 23/00 2/207
6,338,340 B1 * 1/2002 Finch ..... A62B 18/084 128/205.27
6,390,640 B1 5/2002 Wong et al.
6,832,392 B2 12/2004 Palmer et al.
7,178,931 B1 2/2007 Murphy
7,275,269 B2 * 10/2007 Skillman ..... A41D 23/00 2/207
8,549,662 B2 10/2013 Chang
9,661,884 B2 * 5/2017 Yarahmadi ..... A41D 13/1153
2001/0015205 A1 * 8/2001 Bostock ..... A41D 13/1115 128/206.19
2004/0078869 A1 * 4/2004 Bell ..... A41D 13/1161 2/206
2011/0061151 A1 * 3/2011 Chang ..... A41D 13/11 2/424
2011/0067701 A1 * 3/2011 Duffy ..... A41D 13/1115 128/206.19
2014/0259253 A1 * 9/2014 Jacob ..... A41D 13/1161 2/15
2015/0122861 A1 * 5/2015 Adams ..... F41C 33/0218 224/587
2016/0143385 A1 * 5/2016 Krissman ..... H04R 1/10 224/576
2016/0213959 A1 * 7/2016 Barklow ..... A41D 13/1107
2017/0095681 A1 * 4/2017 Smaller ..... A62B 18/02

* cited by examiner

PROTECTIVE GEAR

FIELD OF THE INVENTION

The present invention is generally related to an article of clothing or garment and, more particularly, to a garment which: (i) may be used to cover and protect a user's head, face, neck and adjacent regions; (ii) comprises lights that can be used to illuminate areas the user desires illuminated and lights that protect the user by making the user more visible to others in the area of the user; and comprises fasteners for wiring (e.g., headphone, ear bud, microphone and lighting wiring) and battery compartments.

BACKGROUND ART

Scarves, bandannas, shemaghs and masks (collectively, head gear) have long been used to protect the head and face of the wearer from heat, cold, wind, precipitation, insects, mud, pebbles, sand and dust. Many forms of head gear (e.g., scarves, bandanas and shemaghs) are large squares or rectangles, made of natural fabrics, primarily hydrophilic fibers, such as cotton, which can be folded, wrapped, or twisted around the user to provide protection, visibility, and ease of use. One popular style of wearing such head gear includes folding a large square into a triangle, which facilitates wrapping the head gear around the user's face and head. In general, when wearing head gear in such manner, the user secures the head gear by tying and knotting together two triangle ends, employing varying degrees of snugness in hopes of a correct, secure, and lasting tie-off.

The mask-type head gear comes in many forms. Many of the mask-type head gear cause the user to experience: (i) limited visibility; (ii) lack of comfort; (iii) excessive perspiration; (iv) difficulty breathing; (v) limited coverage of the face, neck and ears; and/or (vi) the inability or limited ability to use the mask-type head gear with the user's choice of eye protection and/or helmet.

One style of mask-type head gear is triangular in shape and incorporates multiple layers/panels. In this style of head gear, the apex of the panels do not form to the user's face. This style of head gear is designed for the outer panel to drape loosely over the user's face and for the inner panel to be draped loosely over the user's face or tucked into the goggles or eye protection worn by the user. Moreover, the apex of the outer panel of this style of head gear forms a straight edge—not a curvilinear/arcuate edge to accommodate the user's goggles or eyewear—requiring the outer layer to fall further down the user's face if the user utilizes larger goggles or protective eyewear. Furthermore, this style of head gear has the inner and outer panels permanently attached to one another via sewing, using a fusible bonding agent, or both. Having the inner and outer panels permanently affixed to one another prevents the user from: (i) removing the inner panel and wearing only the outer panel; (ii) removing the inner panel to launder the inner panel; (ii) removing inner panel and (a) replacing it with a clean or new inner panel after the inner panel has been worn out; (b) replacing the inner panel with an inner panel that is more aesthetically pleasing to the user (i.e., a different color, pattern or material); and/or (c) replacing the inner panel with an inner panel that is more appropriate for the environment (i.e., a thinner/lighter inner panel for warm/humid environments or a thicker/heavier inner panel for cold/dry environments); (iii) removing the outer panel and (a) replacing it with a new outer panel after the outer panel has worn out; and/or (b) replacing the outer panel with different outer panel that is more aesthetically pleasing to the user.

Finally, the prior art with respect to protective head gear does not incorporate lights which can be utilized by the user: (i) as a flashlight; (ii) to make the user more visible to third parties; and/or (iii) to make the head gear more aesthetically pleasing to the user. In addition, the prior art with respect to the protective head gear do not incorporate fasteners for securing: (i) headphone/ear bud wires inside the head gear; (ii) wired microphones inside the head gear in close proximity to the user's mouth; or (iii) battery packs. Moreover, the prior art with respect to the protective head gear do not incorporate drinking, smoking and/or vaping access points for the user. Furthermore, the prior art with respect to the protective head gear do not incorporate pockets inside the protective head gear for storing the user's items.

SUMMARY

Non-exclusive, non-limiting embodiments of the invention illustrated herein provide a protective head gear for a user, which is comprised of an outer panel and inner panel. The outer panel may take any shape (e.g., triangular, semi-circle, oval, square, etc.). Non-exclusive, non-limiting embodiments of the invention illustrated herein, the outer panel may be triangular in shape, having an outer obverse side, an outer reverse side, an outer base and an outer apex. The apex of the outer panel, however, has a peak near the midpoint of the apex, which may align with the center of the base, and a curvilinear/arcuate dip in the edge of the apex on each side of the peak. The peak of the apex aligns with the user's nose and the curvilinear arcuate dips accommodate the goggles/protective eyewear of the user. In embodiments, the edge of apex of the outer panel, from the peak through each curvilinear/arcuate dip, may be reinforced. The reinforcement may be comprised of pliable, malleable metal wires or strips and/or another pliable reinforcement, allowing the user to form the outer panel to his or her nose and face. The reinforcements are positioned so that a small space exists between the reinforcements at the peak of the apex, allowing the protective gear to be folded at the peak of the apex for storage by the user.

The inner panel may take any shape (e.g., triangular, semi-circle, oval, square, etc.); however, the inner panel will generally correspond to the shape of the outer panel. Non-exclusive, non-limiting embodiments of the invention illustrated herein, the inner panel may be triangular in shape, having an inner obverse side, an inner reverse side, an inner base and an inner apex. Like the outer panel, the inner panel has a peak near the midpoint of the apex and a curvilinear/arcuate dip in the edge of the apex on each side of the peak. Although the shape of the inner panel generally corresponds to the shape of the outer panel, the inner panel may not extend through the fastening tabs on the outer panel.

The inner panel and outer panel are attached by two-element fasteners. One element of the fastener will be attached to the reverse side of the outer panel, by sewing, by use of a bonding agent, or both. The other element of the fastener will be attached to the obverse side of the inner panel, by sewing, by use of a bonding agent, or both. A non-limiting example of a two-element fastener, which may be used with gear, includes a hook-and-loop type fastener, with a loop portion generally corresponding to the hook portion fastener element and a hook portion generally corresponding to the loop portion fastener element. In embodiments with fabric hook-and-loop fasteners, the loop portion of the fasteners will be attached to the outer panel and the hook portion of the fasteners will be attached to the inner panel. Attaching the loop portion of the fasteners to the outer panel provides comfort for the user, should the user opt to wear the protective gear without the inner panel. Alternatively, fasteners used to attach the inner and outer panels together may be, without limitation, a button (or stud)-and-eyelet closure, a hook-and-eye closure, a snap closure and/or a toggle or a clasp closure.

Notwithstanding the type of fastener component used to attach the inner and outer panels, the inner and outer panels may be completely separated from one another, allowing the user to remove and replace either panel. The ability to remove and replace both the inner panel and the outer panel is a component of the invention. The ability to remove and replace the each panel affords the user the ability to: (i) remove the inner panel and wear only the outer panel; (ii) remove the inner panel to launder the inner panel; (iii) remove inner panel and (a) replace it with a new inner panel after the inner panel has been worn out; (b) replace the inner panel with an inner panel that is more aesthetically pleasing to the user (i.e., a different color, pattern or material); and/or (c) replace the inner panel with an inner panel embodiment that is more appropriate for the environment (i.e., a thinner/lighter inner panel for warm/humid environments or a thicker/heavier inner panel for cold/dry environments); (iv) remove the outer panel and (a) replace it with a new outer panel after the outer panel has worn out; (b) replace the outer panel with an outer panel that is more aesthetically pleasing to the user; and/or (c) replace the outer panel with an outer panel embodiment that is more appropriate for the environment.

In general, the outer panel and inner panel may be comprised of natural, man-made or manufactured material, or a composite thereof, may be plain or treated material, may be woven or non-woven cloth, and may be constituted of a hydrophobic material, a hydrophilic material, or a hygroscopic material or may be a functional combination of two or more layers of hydrophobic, hydrophilic, or hygroscopic materials. A non-limiting example of distinct inner panel embodiments may be: (i) a unilayer cotton inner panel embodiment; and (ii) a multilayer fleece inner panel embodiment. Different forms of inner panel embodiments allows the user to use a lighter/thinner inner panel embodiment in warm environments and use a heavier/thicker inner panel in cold environments.

In general, the invention will be secured to the user by tabs located at the lateral aspects of the apex of the outer panel. The tabs will use a two-element fastener. One component of the fastener will be attached to the obverse side of one outer panel tab, and the other component of the fastener will be attached to the reverse side of the other outer panel tab. For simplicity, a two-element fastener is depicted as being used with gear, although a fastener used with gear is not so limited. A non-limiting example of a two-element fastener, which may be used with gear, includes a hook-and-loop type fastener, with a loop portion generally corresponding to fastener element and a hook portion generally corresponding to the fastener element. In embodiments with fabric hook-and-loop fasteners, fastener tabs are disposed to adjustably over-lap, so that user may don and doff the protective gear. The fastener will allow the user to don or doff the gear and adjusted the gear to fit the user's face and head, even when the user is wearing gloves.

Other non-exclusive, non-limiting embodiments of the invention illustrated in the form of a protective head gear for a user, may be comprised of designs cut out of the outer panel of the protective gear that are aesthetically pleasing to the user and provide additional ventilation for the user. Other non-exclusive, non-limiting embodiments of the invention illustrated in the form of a protective head gear for a user, may incorporate access through both the inner and outer panels of the invention for the user to utilize when drinking through a straw and/or smoking a pipe, electronic and/or traditional cigarettes.

Other non-exclusive, non-limiting embodiments of the invention illustrated in the form of a protective head gear for a user, may be comprised with illumination apparatus through the use of one or more light emitting diodes ("LEDs") or other forms of lighting devices. The illumination apparatus may include one or more LEDs, wiring, one or more switches and a battery pack. The illumination apparatus may be attachable and detachable from the invention, allowing the user to incorporate the illumination apparatus at any time. The LEDs or other lighting components may be placed anywhere on the outer panel that the user desires, provided there is sufficient area of the outer panel to punch-cut the correct size hole for the LED or lighting component. The LEDs and/or other lighting components used in the illumination apparatus of the invention may vary in colors. In these non-exclusive, non-limiting embodiments, the user may: (i) continuously illuminate apparatus while the protective gear is worn by the user, which provides additional safety to the user, allowing the user to be more visible to third parties, especially when the user utilizes the protective head gear illumination apparatus while traveling on roadways; or (ii) only illuminate the illumination apparatus when the user desires it to be illuminated. Other non-exclusive, non-limiting embodiments of the invention illustrated in the form of a protective head gear for a user, will be comprised with one or more LEDs and/or lighting components at the center of the base of the invention, to provide a flashlight function to the invention. In this embodiment of the invention, the LED(s)/lighting component may be turned on-and-off by the user, and aimed directionally by the user, to illuminate areas that the user desires illuminated.

With respect to the embodiments of the invention that incorporate the illumination apparatus, the wiring for the illumination apparatus may be attached between the two element fasteners that fasten the outer panel to the inner panel, plus additional two element fasteners located at the lateral aspect of the reverse side of the outer panel. The embodiments of the invention that incorporate the illumination apparatus, the switch for the illumination apparatus may be attached to the reverse side of the outer panel by a two-element fastener, sewing, using a fusible bonding agent, or a combination of sewing and a fusible bonding agent. The types of switches for the illumination apparatus may include, without limitation, linear switches, tactile switches, momentary pressure switches, clicky switches and/or non-clicky switches. Finally, the embodiments of the invention that incorporate the illumination apparatus will be powered by a battery pack. The battery pack may be attached to the reverse side of the outer panel of the invention by a two-element fastener.

Other non-exclusive, non-limiting embodiments of the invention illustrated in the form of a protective head gear for a user, may be comprised with a pocket or pockets attached to the reverse side of the outer panel by sewing, using a fusible bonding agent, or a combination of sewing and a fusible bonding agent. The pocket(s) allow the user to store small items in the mask.

BRIEF DESCRIPTION OF DRAWINGS

The present invention is illustrated by way of example and not by limitation in the accompanying figures, in which like references indicate similar elements, and in which.

and

Figure 9:
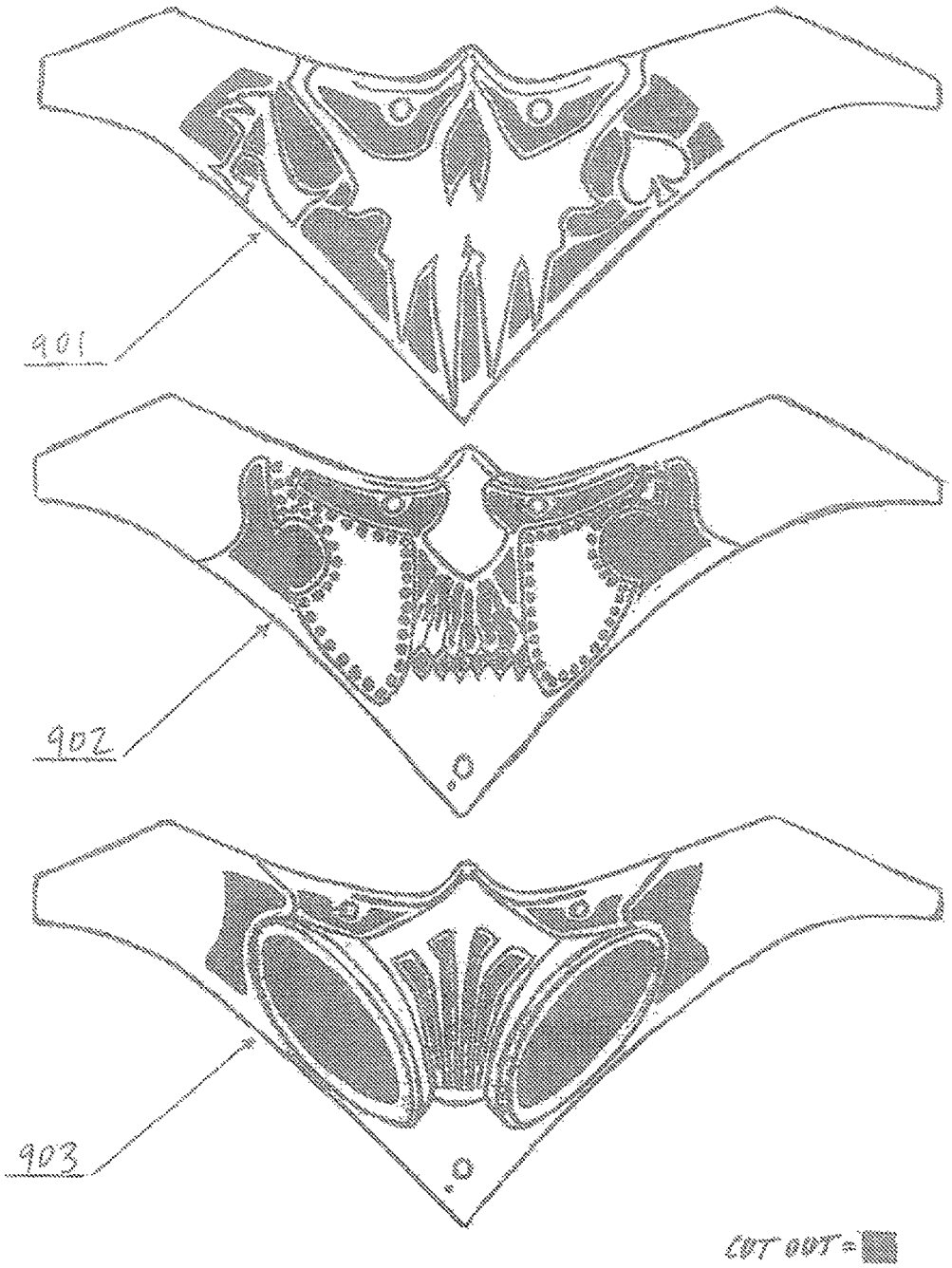

FIG. 9 are three illustrations of the obverse sides of the outer panels 200 of three embodiments of protective gear 901, 902 & 903 demonstrating, without limitation, varying styles of the cut-out designs of the invention.

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention

DETAILED DESCRIPTION OF THE EMBODIMENTS

Figure 1:
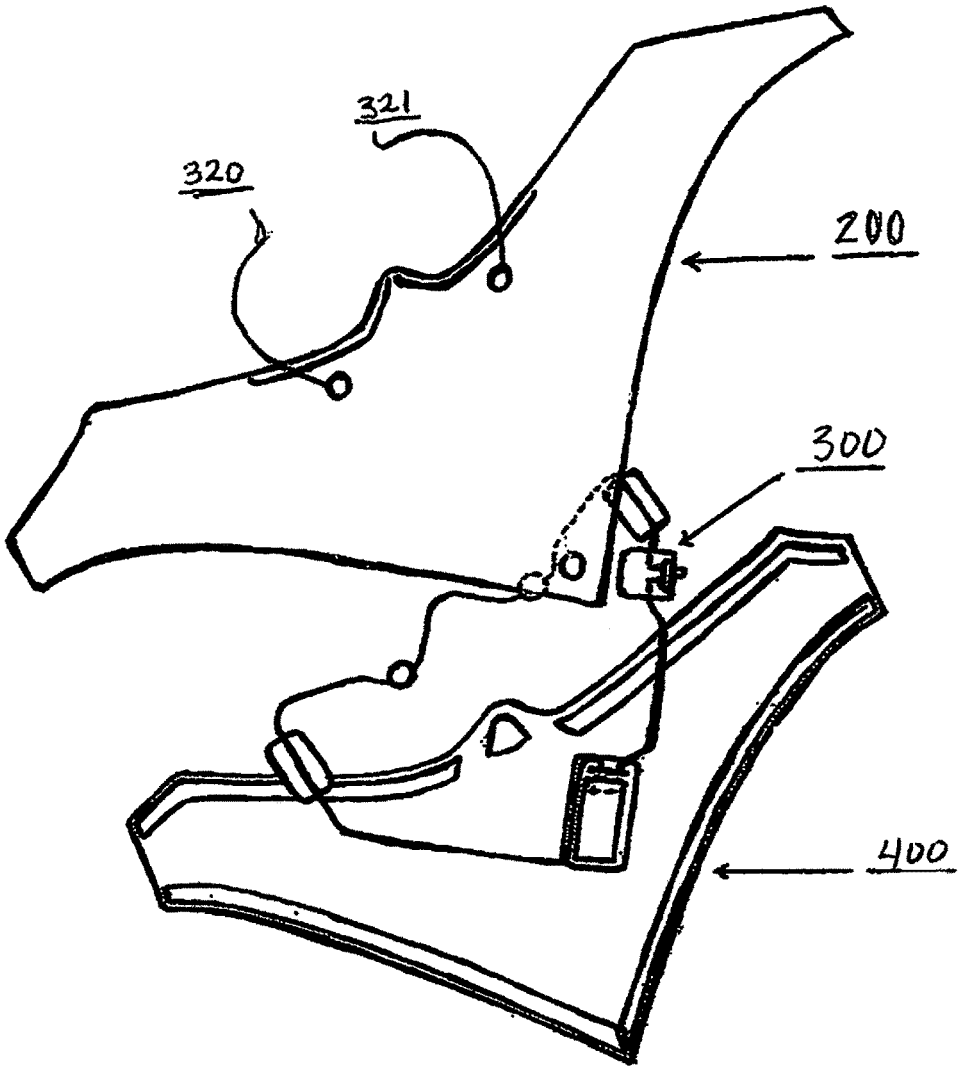
FIG. 1 is an illustration of a sectional view of an embodiment of the protective gear 100, illustrating the sections of the outer panel 200, illumination apparatus 300 and inner panel 400 of the protective gear in accordance with the teachings of the invention herein.
Figure 6:
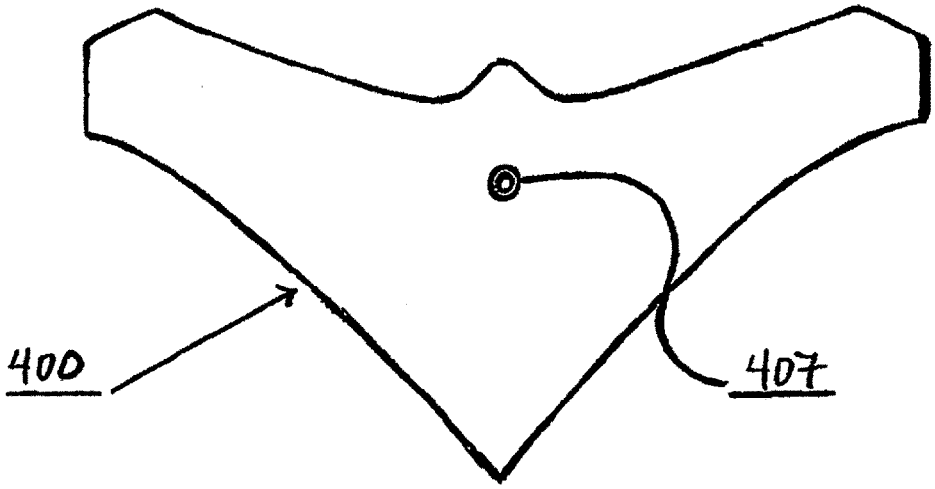
FIG. 6 is an illustration of a view of the reverse side of an inner panel 400 of the embodiment of protective gear 100 in accordance with the teaching of the invention herein.
Figure 7:
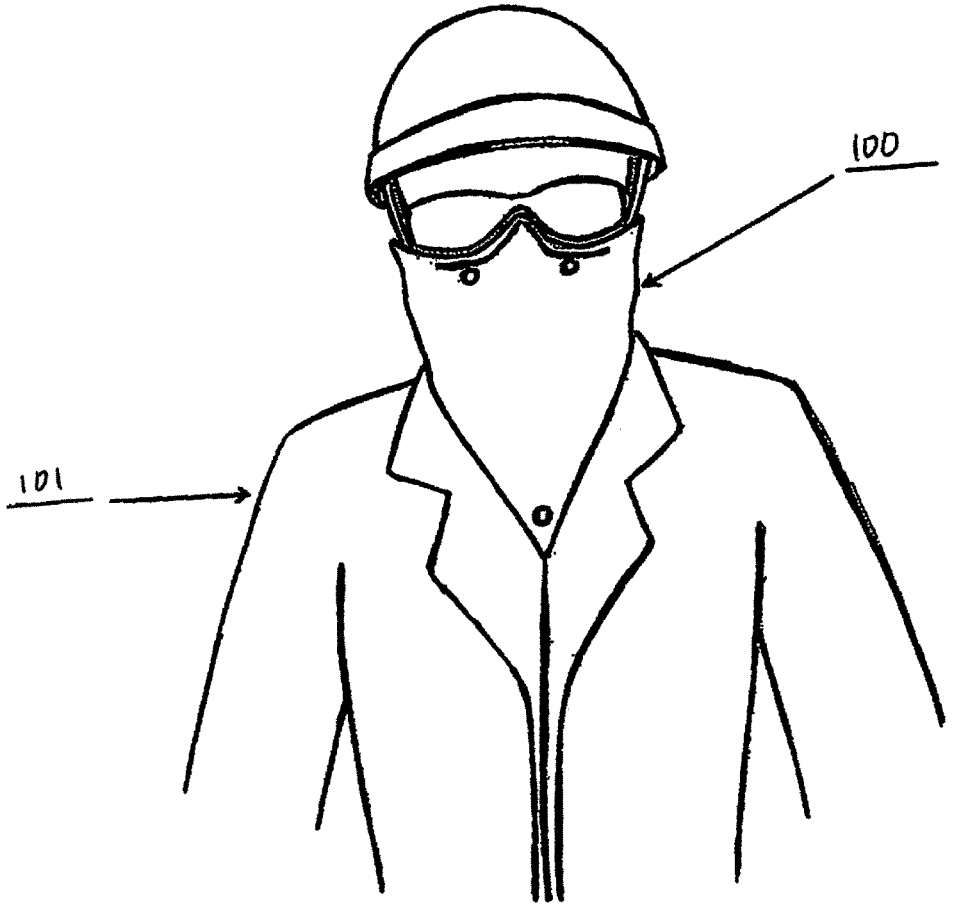
FIG. 7 is an illustration of a front view of an embodiment of protective gear 100 in accordance with the teaching of the invention herein, as may be disposed on a user 101.
Figure 8:
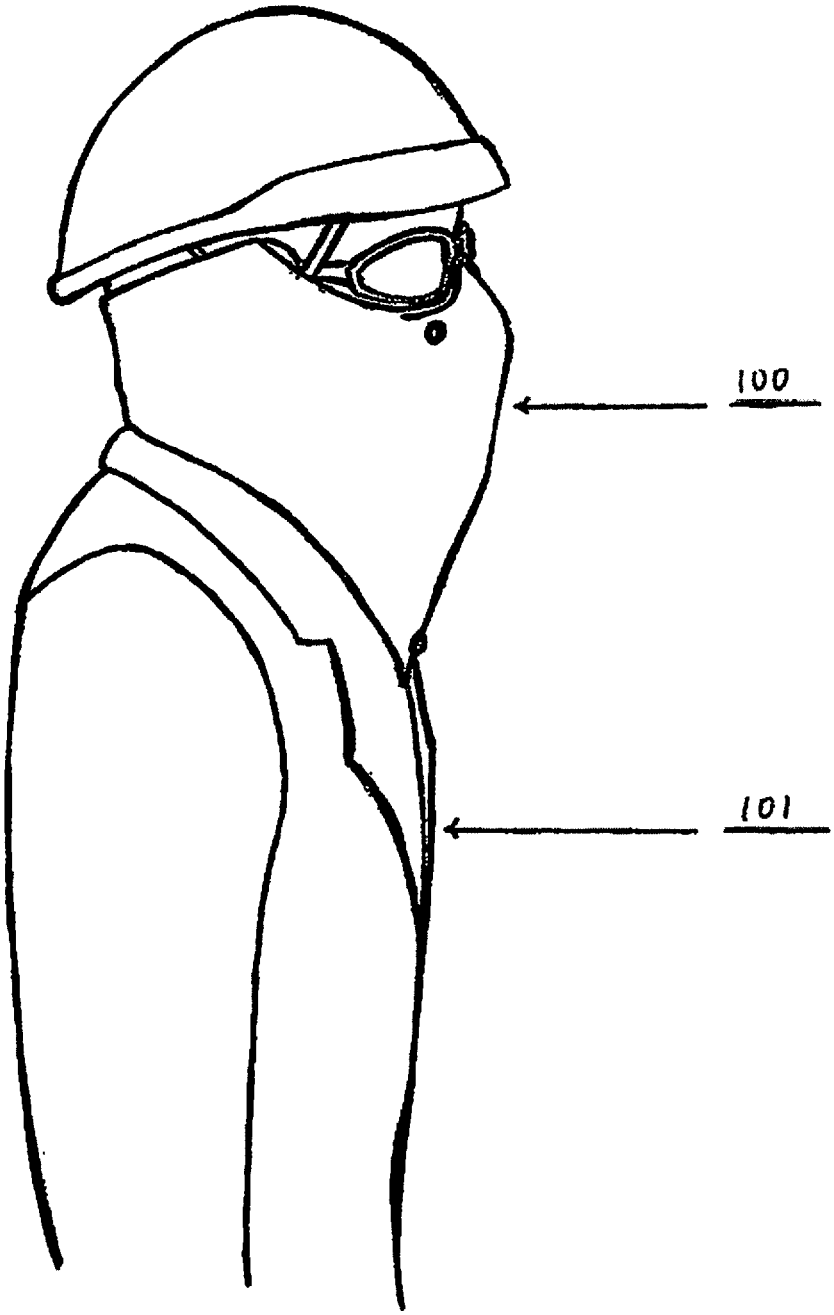
FIG. 8 is an illustration of a right-side view of an embodiment of protective gear 100 in accordance with the teaching of the invention herein, as may be disposed on a user 101.

FIGS. 7 & 8 illustrate the protective gear disposed on the user. FIG. 1 illustrates a front sectional view of an embodiment of gear 100, comprising the outer panel 200, the illumination apparatus 300 and the inner panel 400. FIG. 9 illustrates three non-exclusive, non-limiting embodiments of the gear 100 comprised with cut-out designs, e.g., FIGS. 9 (901, 902 & 903) that may be aesthetically pleasing to the user and provide additional ventilation for the user. FIG. 7 illustrates a front view of an embodiment of gear 100, as maybe worn by user 101. Regarding the protective gear 100, which can be in accordance with present embodiments, may include, without limitation: (i) an outer panel FIGS. 1 & 2, 200; (ii) one or more outer panel pockets FIGS. 3, 318 & 319; (iii) illumination apparatus FIGS. 4, 300 and/or 301; (iv) an inner panel FIGS. 1 & 5, 400; (v) cut-out designs (e.g., FIG. 9, 901, 902 or 903); and/or (vi) access through both the outer panel 200 (e.g., FIG. 9, 901, 902 or 903) and the inner panel 400 (FIGS. 5 & 6, 407) for drinking, vaping and/or smoking.

Figure 2:
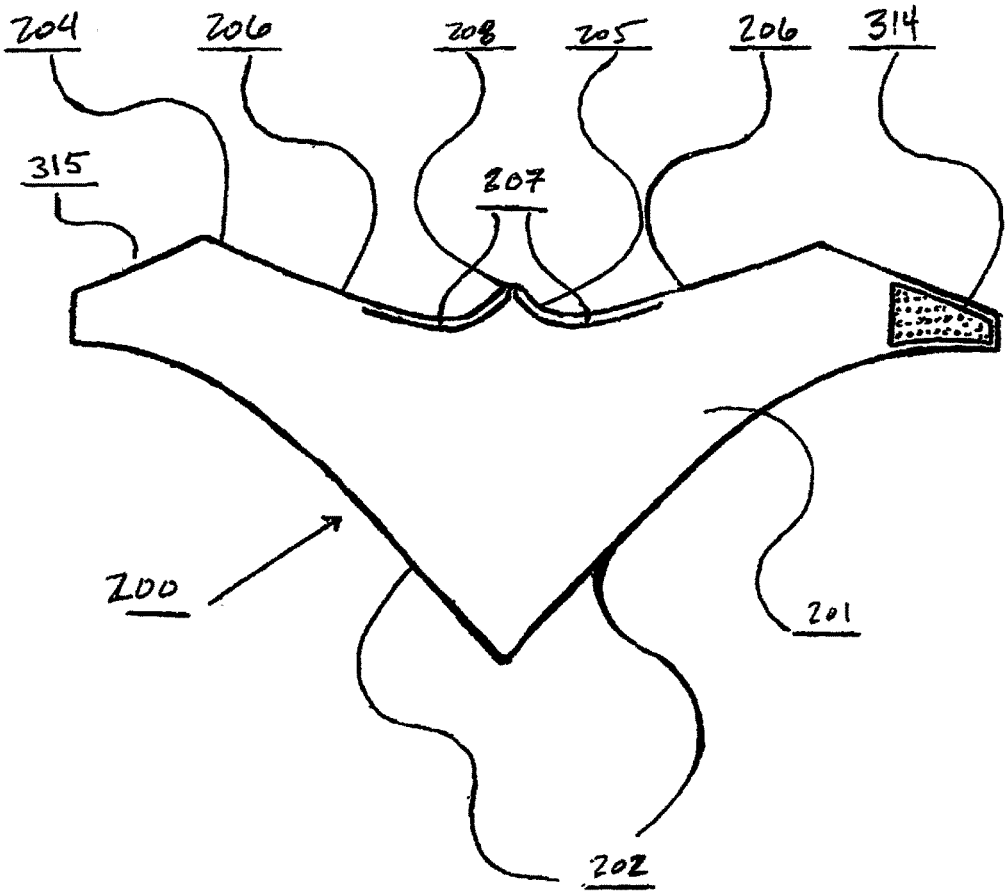
FIG. 2 is an illustration of a front view of the obverse side of an outer panel 200 of an embodiment of protective gear 100 in accordance with the teaching of the invention herein.
Figure 5:
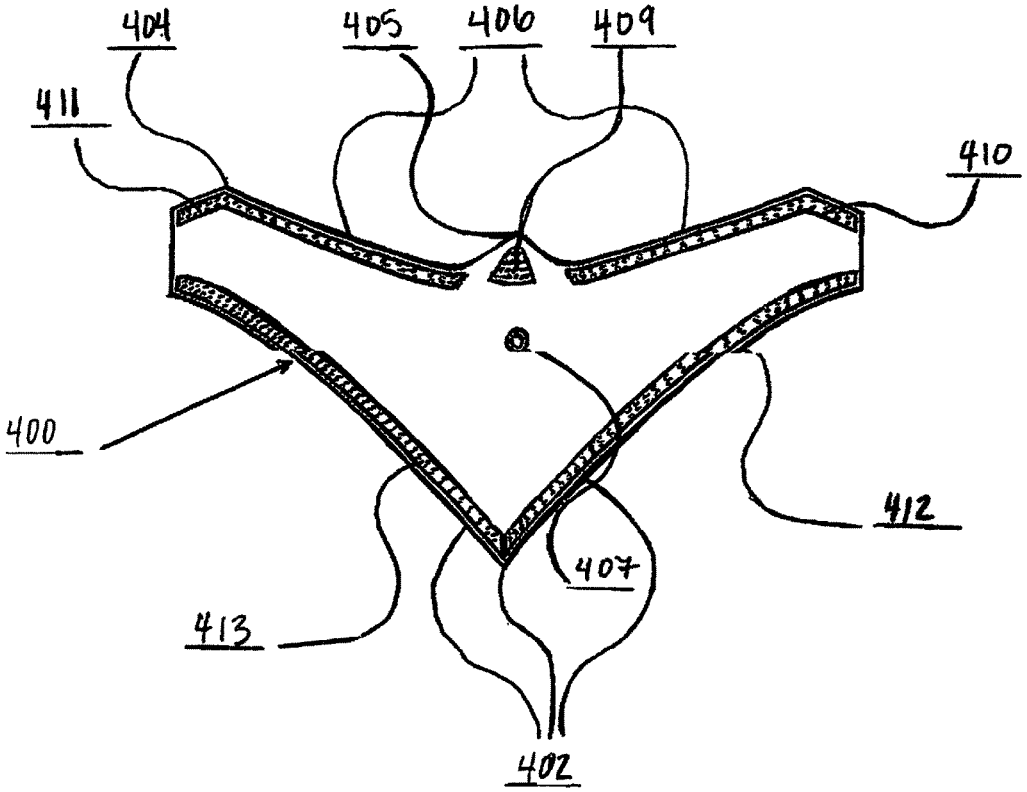
FIG. 5 is an illustration of a view of the obverse side of the inner panel 400 of an embodiment of protective gear 100 in accordance with the teaching of the invention herein.

Other non-exclusive, non-limiting embodiments of the invention illustrated herein provide a protective head gear for a user, which is comprised by an outer panel FIGS. 1 & 2, 200 and inner panel FIGS. 1 & 5, 400. The outer panel has an outer obverse side FIG. 2, 201, an outer reverse side FIG. 3, 203, a base FIGS. 2 & 3, 202 and an apex FIGS. 2 & 3, 204. The apex of the outer panel, however, has a peak FIGS. 2 & 3, 205 near the midpoint of the apex, which aligns generally with the center of the base, and a curvilinear/arcuate dip FIGS. 2 & 3, 206 in the edge of the apex FIGS. 2 & 3, 204 on each side of the peak FIGS. 2 & 3, 205. The peak FIGS. 2 & 3, 205 of the outer panel FIGS. 2 & 3, 200 coordinates with the nose of the user FIG. 7, 101 and the curvilinear/arcuate dips FIGS. 2 & 3, 206 of the apex FIGS. 2 & 3, 204 of the outer panel accommodate the goggles/protective eyewear of the user FIG. 7, 101. Both curvilinear/arcuate dips FIGS. 2 & 3, 206 on each side of the peak FIGS. 2 & 3, 205 of the apex FIGS. 2 & 3, 204 ultimately curve upward, toward the lateral aspects of the apex FIGS. 2 & 3, 204 of the outer panel. In certain embodiments, the edge of apex FIG. 2, 204 of the outer panel FIG. 2, 200, from the peak FIG. 2, 205 through each curvilinear/arcuate dip FIG. 2, 206, may be reinforced. The reinforcements may be comprised of pliable, malleable metal wires, strips or other pliable reinforcing material, FIG. 2, 207, allowing the user FIGS. 7 & 8, 101 to form the apex FIG. 2, 204 of the outer panel 200 to the user's FIGS. 7 & 8, 101 nose and face. The reinforcements FIG. 2, 207 may be positioned on each side of the peak FIG. 2, 205 and through the curvilinear/arcuate dip FIG. 2, 206 of the outer panel FIG. 2, 200. The reinforcements FIG. 2, 207 may be positioned so that a small space FIG. 2, 208 exists between the reinforcements at the peak FIG. 2, 205 of the apex FIG. 2, 204, allowing the protective gear to be folded at the peak FIG. 2, 205 of the apex FIG. 2, 204 for storing the protective gear.

Figure 3:
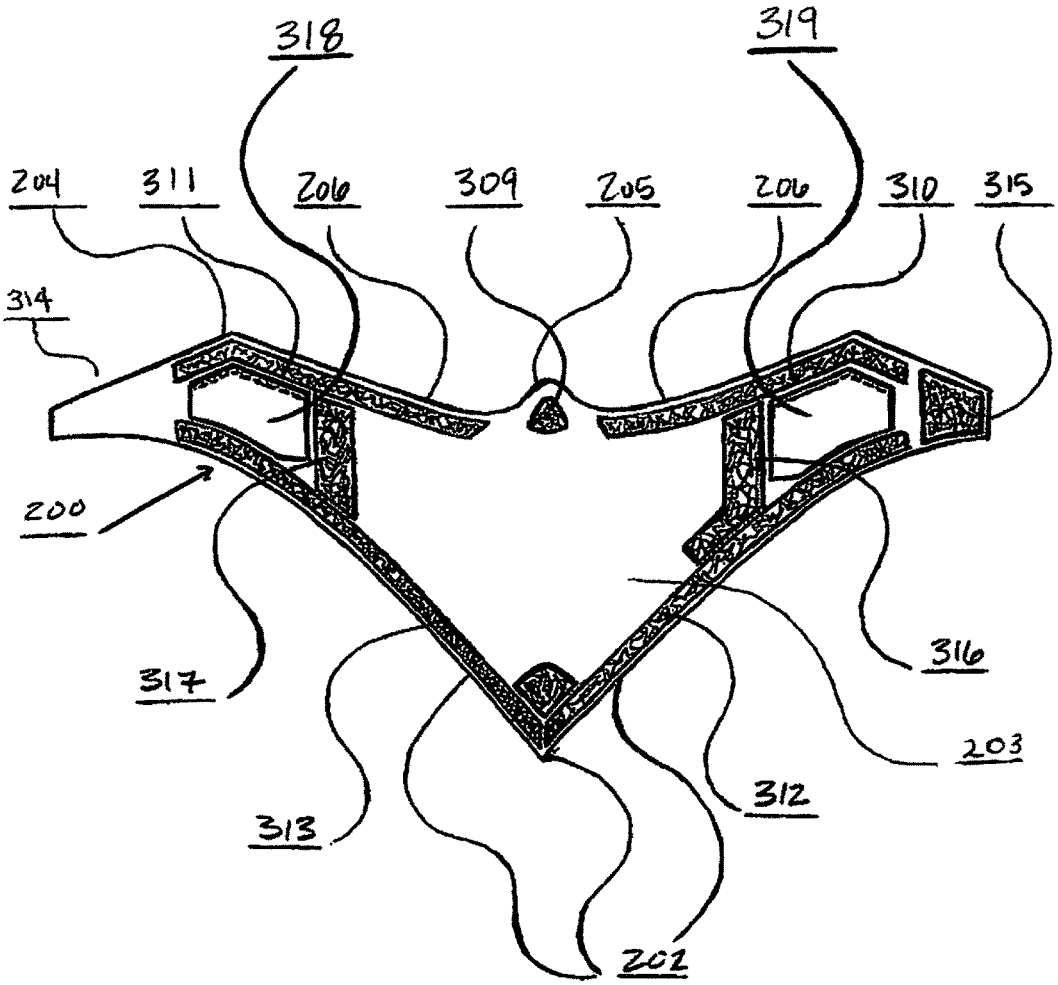
FIG. 3 is an illustration of a view of the reverse side of an outer panel 200 of an embodiment of protective gear 100 in accordance with the teaching of the invention herein.

The inner panel FIGS. 5 & 6, 400 of the protective gear corresponds generally with the shape of the outer panel FIGS. 2 & 3, 200. The inner panel 400 has an inner obverse side FIG. 5, an inner reverse side FIG. 6, a base FIG. 5, 402 and an apex FIG. 5, 404. The apex FIG. 5, 404 of the inner panel has a peak FIG. 5, 405 near the midpoint of the apex FIG. 5, 404 and a curvilinear/arcuate dip FIG. 5, 406 in the edge of the apex FIG. 5, 404 on each side of the peak FIG. 5, 405. The peak FIG. 5, 405 and dips FIG. 5, 406 of the inner panel FIG. 5, 400 generally correspond to the peak FIG. 2, 205 and dips FIG. 2, 206 of the outer panel FIG. 2, 200 and accommodate the goggles/protective eyewear of the user FIG. 7, 101. Both curvilinear/arcuate dips FIG. 5, 406 ultimately curve upward, toward lateral aspects of the apex FIG. 5, 404 of the inner panel FIG. 5, 400. The shape of the inner panel FIG. 5, 400 generally corresponds to the shape of the outer panel FIG. 2, 200, except the inner panel FIG. 5, 400 may not extend to the through the fastening tabs on the outer panel FIGS. 2, 314 & 315.

The outer panel FIG. 3, 200 and inner panel FIG. 5, 400 are attached by two-element fasteners FIGS. 3, 309, 310, 311, 312 & 313; and FIGS. 5, 409, 410, 411, 412 & 413. One element of the fastener will be attached to the reverse side of the outer panel FIGS. 3, 309, 310, 311, 312 & 313, by sewing, by use of a bonding agent, or both. The other element of the fastener will be attached to the obverse side of the inner panel FIGS. 5, 409, 410, 411, 412 & 413, by sewing, by use of a bonding agent, or both. The two-element fasteners attaching the inner and outer panels may be located as follows: (i) outer panel FIG. 3, 200: (a) two fasteners FIGS. 3, 310 & 311 along the perimeter of the apex FIG. 3, 204 of the outer panel, each starting immediately lateral to the peak FIG. 3, 205 of the apex FIG. 3, 204 and traveling along the apex's perimeter to the lateral aspect of the apex FIG. 3, 204, stopping just prior to the tabs FIGS. 3, 314 & 315 that secure the protective gear to the user; (b) a fastener FIG. 3, 309 located at the peak FIG. 3, 205 of the apex FIG. 3, 204 of the outer panel FIG. 3, 200; and (c) one or more fastener(s) FIGS. 3, 312 & 313 along the perimeter of the base FIG. 3, 202 of the outer panel FIG. 3, 200, starting at one lateral aspect of the base FIG. 3, 202, at the medial aspect of the tab FIG. 3, 314 securing the protective gear to the user and traveling along the perimeter of the base FIG. 3, 202 to the other lateral aspect of the base FIG. 3, 202, just prior to the tab FIG. 3, 315 securing the protective gear to the user; and (ii) inner panel FIG. 5, 400: (a) two fasteners FIGS. 5, 410 & 411 along the perimeter of the apex FIG. 5, 404 of the inner panel FIG. 5, 400, each starting immediately lateral to the peak FIG. 5, 405 of the apex FIG. 5, 404 and traveling along the apex's perimeter to the lateral aspect of the apex FIG. 5, 404; (b) a fastener FIG. 5, 409 located at the peak FIG. 5, 405 of the apex FIG. 5, 404 of the inner panel FIG. 5, 400; and (c) one or more fastener(s) FIGS. 5, 412 & 413 along the perimeter of the base FIG. 5, 402 of the outer panel FIG. 5, 400, starting at one lateral aspect of the base FIG. 5, 402, and traveling along the perimeter of the base FIG. 5, 402 to the other lateral aspect of the base FIG. 5, 402. The two-element fasters of the outer and inner panels will generally correspond with one another.

A non-limiting example of a two-element fastener, which may be used with gear, includes a hook-and-loop type fastener, with a loop portion generally corresponding to the hook portion fastener element and a hook portion generally corresponding to the loop portion fastener element. In embodiments with fabric hook-and-loop fasteners, the loop portion of the fasteners will be attached to the outer panel FIG. 3, 200 and the hook portion of the fasteners will be attached to the inner panel FIG. 5, 400. Attaching the loop portion of the fasteners to the outer panel FIG. 3, 200 provides comfort for the user FIG. 7, 101, should the user opt to wear the protective gear without the inner panel. Alternatively, fasteners used to attach the inner and outer panels FIG. 3, 200 & FIG. 5, 400 together may be, without limitation, a button (or stud)-and-eyelet closure, a hook-and-eye closure, a snap closure and/or a toggle or a clasp closure.

Regardless the type of fastener component used to attach the inner and outer panels FIG. 3, 200 & FIG. 5, 400, the inner and outer panels may be completely separated from one another, allowing the user to remove and replace either panel. The ability to remove and replace both the outer panel FIG. 3, 200 and the inner panel FIG. 5, 400 is a component of the invention. The ability to remove and replace the each panel affords the user the ability to: (i) remove the inner panel FIG. 5, 400 and wear only the outer panel FIG. 3, 200; (ii) remove the inner panel to launder the inner panel; (iii) remove inner panel and (a) replace it with a new inner panel after the inner panel has been worn out; (b) replace the inner panel with an inner panel that is more aesthetically pleasing to the user (i.e., a different color, pattern or material); and/or (c) replace the inner panel with an inner panel embodiment that is more appropriate for the environment (i.e., a thinner/lighter inner panel for warm/humid environments or a thicker/heavier inner panel for cold/dry environments); (iv) remove the outer panel FIG. 3, 200 and (a) replace it with a new outer panel after the outer panel has worn out; and/or (b) replace the outer panel with an outer panel that is more aesthetically pleasing to the user; (c) replace the outer panel with an outer panel embodiment that is more appropriate for the environment. In general, the outer panel FIG. 3, 200 and inner panel FIG. 5, 400 may be comprised of natural, man-made or manufactured material, or a composite thereof, may be plain or treated material, may be woven or non-woven cloth, and may be constituted of a hydrophobic material, a hydrophilic material, or a hygroscopic material or may be a functional combination of two or more layers of hydrophobic, hydrophilic, or hygroscopic materials. One or both of outer and inner panels may be a sized portion of leather, artificial leather, vinyl and/or cloth, which may be unilayer or multilayer, and may be generally soft and flexible. A non-limiting example of distinct inner panel FIG. 5, 400 embodiments may be: (i) a unilayer cotton inner panel embodiment; and (ii) a multilayer fleece inner panel embodiment. For a user possessing both of the above examples of inner panel embodiments, the user may use the unilayer cotton inner panel embodiment in warm environments and may use the multilayer fleece inner panel embodiment in cold environments. In addition, a user may have multiple single inner panel embodiments. A non-limiting example of multiple inner panel embodiments is a user who possesses several unilayer cotton inner panel embodiments, allowing the user to periodically remove the inner panel and replace it with another unilayer cotton inner panel embodiment. This allows the user to replace the inner panel with an inner panel that is more aesthetically pleasing to the user, or to remove a soiled inner panel for laundering and replacing the soiled inner panel with a clean unilayer cotton inner panel embodiment.

In general, the lateral aspects of the outer panel FIGS. 2 & 3, 200 will be comprised of tabs FIGS. 2 & 3, 314 & 315 for securing the protective gear to the user. The tabs will be joined by two-element fasteners FIG. 2, 314 & FIG. 3, 315. The two element fasteners FIG. 2, 314 & FIG. 3, 315 may be attached to the outer panel tabs by sewing, by use of a bonding agent, or both. One component of the two-element fastener will be attached to the obverse side of one outer panel tab FIG. 2, 314, and the other component of the fastener will be attached to the reverse side of the other outer panel tab FIG. 3, 315. For simplicity, a two-element fastener is depicted as being used with gear, although a fastener used with gear is not so limited. A non-limiting example of a two-element fastener, which may be used with gear, includes a hook-and-loop type fastener, with a loop portion generally corresponding to fastener element and a hook portion generally corresponding to corresponding to fastener element. In embodiments with fabric hook-and-loop fasteners, fastener tabs FIG. 2, 314 & FIG. 3, 315 are disposed to adjustably over-lap, so that user may don and doff the protective gear. Alternatively, the fastener may be, without limitation, a button (or stud)-and-eyelet closure, a hook-and-eye closure, a snap closure, a tie closure, a toggle, or a clasp closure. However, use of a generally soft, pliant, and secure yet easy-to-remove fastener may minimize injury which may occur from a vigorous or even forceful thrust of the fastener against a proximate portion of the body or head/face of the user. The fastener will allow the user FIG. 7, 101 to don or doff the gear and adjust the gear to fit the user's face and head, even if user may be wearing gloves.

Other non-exclusive, non-limiting embodiments of the invention illustrated in the form of a protective head gear for a user, may incorporate a plurality of design cut outs (e.g., FIGS. 9, 901, 902 & 903 of the outer panel of the protective gear that are aesthetically pleasing to the user and provide additional ventilation for the user. Other non-exclusive, non-limiting embodiments of the invention illustrated in the form of a protective head gear for a user, may be comprised with an access FIGS. 5 & 6, 407 through the inner panel; and access through the cut-outs FIGS. 9, 901, 902 & 903 of the outer panel of the invention for the user to utilize when drinking through a straw and/or smoking a pipe, electronic and/or traditional cigarettes.

Other non-exclusive, non-limiting embodiments of the invention illustrated in the form of a protective gear for a user, may be comprised with a single or plurality of pocket (s), e.g., FIGS. 3, 318 & 319 attached to the reverse side of the outer panel FIG. 3, 200. For embodiments of the invention that incorporate pocket(s), the pocket(s) may be attached to the reverse side of the outer panel FIG. 3, 200 by sewing, using a fusible bonding agent, or a combination of sewing and a fusible bonding agent. The user may utilize the pocket(s) to store small items.

Figure 4:
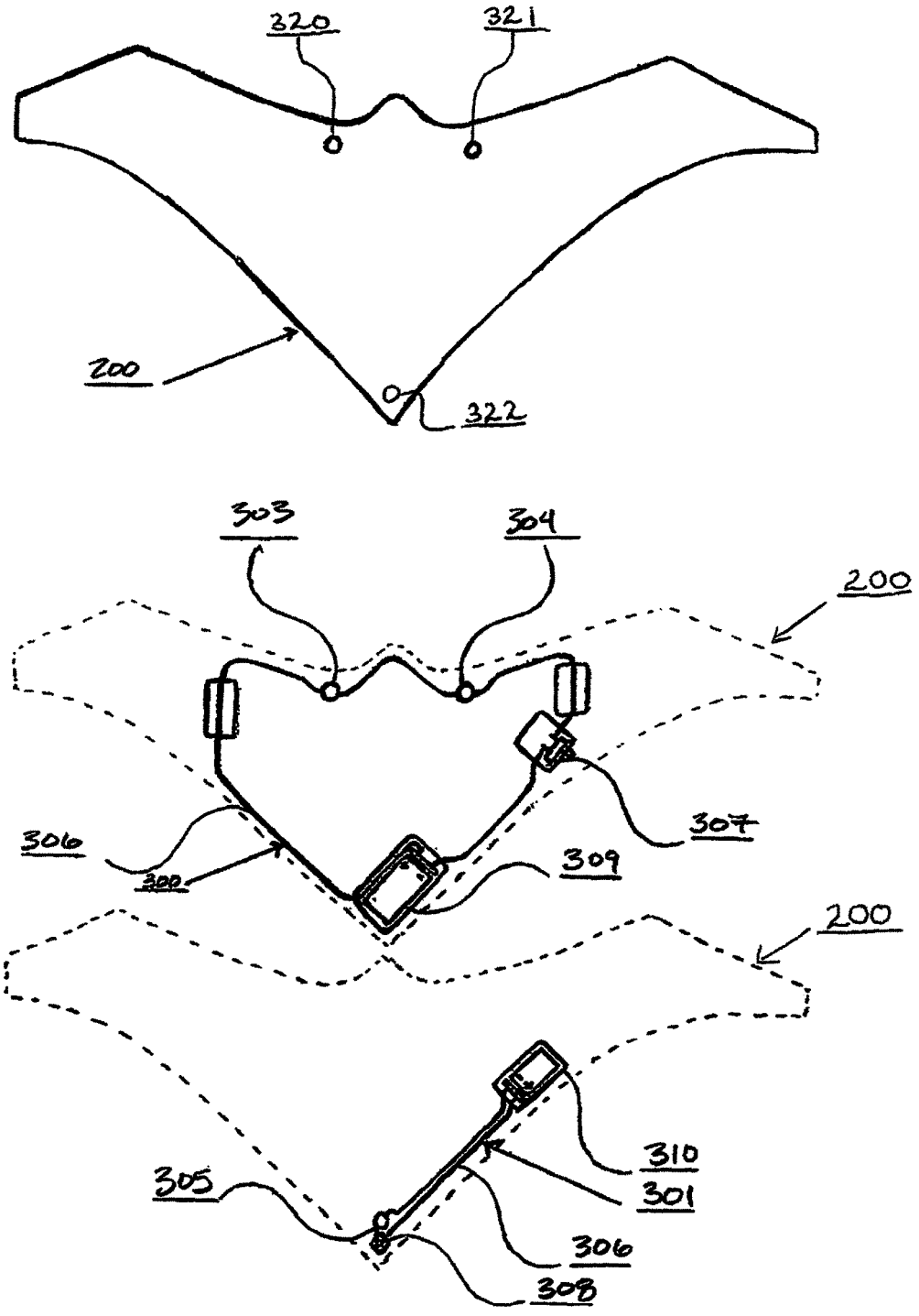
FIG. 4 is an illustration of a transparent view of the obverse side of the outer panel 200 of an embodiment of protective gear 100 incorporating the illumination apparatus 300 and/or 301 demonstrating LED/lighting components 303, 304 and/or 305, wiring 306, switch(es) 307 and/or 308 and battery pack(s) 309 and/or 310 in accordance with the teaching of the invention herein.

Other non-exclusive, non-limiting embodiments of the invention illustrated in the form of a protective gear for a user, may be comprised of, or configured to receive, illumination apparatus FIGS. 4, 300 & 301. The illumination apparatus may be comprised LEDs or other lighting components. The illumination apparatus may include one or more LEDs/lighting components, FIGS. 4, 303, 304 & 305, wiring FIG. 4, 306, one or more switches FIGS. 4, 307 and/or 308 and one or more battery pack(s) FIGS. 4, 309 & 310. The illumination apparatus FIG. 4, 300 may be attachable and detachable from the invention, allowing the user to incorporate the illumination apparatus at any time.

The LEDs/lighting components, e.g., FIGS. 4, 303, 304 & 305, will be attached to the outer panel of the protective gear by punch-cutting one or more hole(s), e.g., FIGS. 4, 320, 321 & 322, in the outer panel FIG. 4, 200 where the LED(s)/lighting component(s), e.g., FIGS. 4, 303, 304 and/or 305, will be located and pressing the LED(s)/lighting component(s) 303, 304 and/or 305 through the reverse side of the outer panel's FIG. 4, 200 punch-cut hole(s), e.g., FIGS. 4, 320, 321 and/or 322. A non-exclusive, non-limiting embodiment of the invention may be comprised with an illumination apparatus FIG. 4, 300 with LEDs/lighting components FIGS. 4, 303 & 304 located on the outer panel FIG. 4, 200, immediately inferior to the user's eyes FIGS. 4, 320 & 321. When placed immediately inferior to the user's eyes FIGS. 4, 320 & 321, the reinforcements (e.g., metal wires, strips or other pliable reinforcements) FIG. 2, 207 incorporated into the edge of apex FIG. 2, 204 of the outer panel FIG. 2, 200, from the peak FIG. 2, 205 through each curvilinear/arcuate dip FIG. 2, 206 (to form fit the protective gear to the user's face), diminishes the effect of the LED light FIGS. 4, 303 & 304 from interfering with the user's vision. In other non-exclusive, non-limiting embodiments of the invention, the LED(s)/lighting component(s) may be placed anywhere on the outer panel FIG. 2, 200 that the user desires, provided there is sufficient area of the outer panel o punch-cut the correct size hole for the LED(s)/lighting components. The LEDs/lighting components, e.g., FIGS. 4, 303, 304 and/or 305, used in the illumination apparatus FIGS. 4, 300 and/or 301 of the invention may vary in colors. In these non-exclusive, non-limiting embodiments, the user may: (i) continuously illuminate the apparatus while the protective gear is worn by the user, which provides additional safety to the user, allowing the user to be more visible to third parties, especially when the user utilizes the protective gear illumination apparatus while traveling on roadways; or (ii) only illuminate the apparatus when the user desires the LED(s)/lighting component(s) to be illuminated. Other non-exclusive, non-limiting embodiments of the invention illustrated in the form of a protective head gear for a user, may be comprised of one or more LED(s)/lighting component(s) FIG. 4, 305 at the center of the base of the invention, to provide a flashlight function to the invention. In this embodiment of the invention, the LED(s)/lighting component(s) FIG. 4, 305 may be turned on-and-off by the user, and aimed directionally by the user, to illuminate areas that the user desires illuminated.

With respect to the embodiments of the invention that incorporate the illumination apparatus, the wiring FIG. 4, 306 for the illumination apparatus may be attached between the two element fasteners FIGS. 3, 309, 310, 311, 312, 313, 316 & 317; and FIGS. 5, 509, 510, 511, 512 & 513, that attach the outer panel FIG. 3, 200 to the inner panel FIG. 5, 400, plus additional two element fasteners located on the reverse side of the outer panel FIGS. 3, 316 & 317. In non-exclusive, non-limiting example of the embodiments incorporating the hook-and-loop fastener, the wiring FIG. 4, 306 of the illumination apparatus, e.g., FIGS. 4, 300 and/or 301, may be secured between the two elements of the fasteners attaching the outer panel and inner panel, plus additional two-element fasteners in which only one element of the fastener FIGS. 3, 316 & 317 is attached to the reverse side of the outer panel and the other element of the fastener FIGS. 3, 316 & 317 is not attached (i.e., stands alone). The embodiments of the invention that incorporate the illumination apparatus, the switch and/or switches FIGS. 4, 307 and/or 308 for the illumination apparatus FIGS. 4, 300 and/or 301 may be attached to the reverse side of the outer panel FIG. 3 by two-element fastener(s), by sewing, using a fusible bonding agent, or a combination of sewing and a fusible bonding agent. A non-limiting example of a two-element fastener includes a hook-and-loop type fastener, with a loop portion generally corresponding to the hook portion fastener element and a hook portion generally corresponding to the loop portion fastener element. In embodiments with fabric hook-and-loop fasteners, the loop portion of the fasteners will be attached to the reverse side of the outer panel FIG. 3, 200 and the hook portion of the fasteners will be attached to the switch FIGS. 4, 307 & 308. The types of switches for the illumination apparatus may be comprised of, without limitation, linear switches, tactile switches, momentary pressure switches, clicky switches and/or non-clicky switches. Finally, the embodiments of the invention that incorporate the illumination apparatus will be powered by one or more battery pack(s) FIGS. 4, 309 and/or 310. The battery pack(s) FIGS. 4, 309 and/or 310 may be attached to the reverse side of the outer panel FIG. 3 of the invention via a two-element fastener. A non-limiting example of a two-element fastener includes a hook-and-loop type fastener, with a loop portion generally corresponding to the hook portion fastener element and a hook portion generally corresponding to the loop portion fastener element. In embodiments with fabric hook-and-loop fasteners, the loop portion of the fasteners will be attached to the reverse side of the outer panel FIGS. 3, 312, 313, 316 & 317 and the hook portion of the fasteners will be attached to the battery pack(s) FIGS. 4, 309 and/or 310. Attaching the loop portion of the fasteners to the outer panel provides comfort for the user, should the user opt to wear the protective gear without the illumination apparatus and without the inner panel.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprise," "comprises," "comprising," or any other variation thereof, are intended to cover a non-exclusive inclusion, such that a Process, method, article, or apparatus that comprises a list of elements does not include only those elements but may include other elements not expressly listed or inherent to such process, method, article, or apparatus. The terms "a" or "an", as used herein, are defined as one, or more than one. The term "plurality," as used herein, is defined as two, or more than two. The term "another", as used herein, is defined as at least a second or more. The terms "including" and/or "having", as used herein, are defined as "comprising" (i.e., open language). The term "attached", as used herein, is defined as connected, although not necessarily directly.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention, as defined by the appended claims.

What is claimed is:

1. A protective gear for a user, comprising:

an outer panel having an outer obverse side and an outer reverse side, the outer panel having an outer base and an outer apex;

an inner panel having an inner obverse side and an inner reverse side, the inner panel having an inner base and an inner apex;

wherein the shape of said inner panel generally corresponds with the shape of said outer panel, wherein the outer panel is comprised of at least one layer of material, wherein the inner panel is comprised of at least one layer of material, wherein the outer panel has at least one opening, and wherein the outer and inner panels are releasably attachable to one another and each configured for use alone or together by the user.

2. The protective gear of claim 1, further comprising:

at least one two-element fastener, which temporarily and releasably attaches the outer panel to the inner panel;

wherein one element of the two-element fastener is attached to the reverse side of the outer panel and the other element of the two-element fastener is attached to the obverse side of the inner panel, wherein a positioning of each element of the two-element fastener on the outer panel and the inner panel generally correspond with one another, wherein the two-element fastener, attaching the outer panel to the inner panel, allows the outer panel and the inner panel to be completely separated from one another, and wherein a female element of the two-element fastener is attached to the reverse side of the outer panel, allowing the user to wear the outer panel with or without an inner panel.

3. The protective gear of claim 2, further comprising:

fastening tabs located at the lateral aspects of the outer panel for securing the protective gear to the user;

wherein a two-element fastener is attached to the fastening tabs for the user to adjustably and releasably secure at least a portion of the protective gear to the user, and wherein one element of the two-element fastener is attached to the obverse side of one of the outer panel's fastening tabs and another element of the two-element fastener is attached to the reverse side of the outer panel's other fastening tab.

4. The protective gear of claim 2 wherein the at least one opening in the outer panel is an aesthetic cut-out design.

5. The protective gear of claim 2, further comprising:

a peak and curvilinear dips of the apex of both the outer panel and the inner panel;

wherein the peak of the outer panel aligns with the center of the base, and the curvilinear dips of the edge of the apex begin on each side of the peak, curving downward, and ultimately curve upward toward lateral aspects of the apex of the outer panel, wherein the peak of the inner panel aligns with the center of the base, and the curvilinear dips in the edge of the apex begin on each side of the peak, curving downward, and ultimately curve upward toward lateral aspects of the apex of the inner panel, wherein the peak and curvilinear dips of the inner panel generally correspond with the peak and curvilinear dips of the outer panel, and wherein the peaks of the outer and inner panels coordinate with the nose of the user and the curvilinear dips of the apex of the outer and inner panels accommodate protective eyewear of the user.

6. The protective gear of claim 5, further comprising:

pliable reinforcements attached to the apex of said outer panel;

wherein the reinforcements are positioned on each side of the peak of the apex of the outer panel and extend at least partially through the curvilinear dip of the outer panel, wherein the reinforcements are comprised of pliable material, allowing the user to form the apex of the outer panel to the user's nose and face, and wherein the reinforcements are positioned so that a small space exists between the reinforcements at the peak of the apex of the outer panel, allowing the protective gear to be folded at the peak of the apex.

7. The protective gear of claim 1, further comprising:

an illumination apparatus.

8. The protective gear of claim 6 further comprising:

at least one pocket adjacent to the reverse side of the outer panel for receiving items.

9. The protective gear of claim 2, further comprising:

at least one opening in said inner panel;

wherein the at least one opening in the inner panel corresponds to the at least opening in the outer panel, and wherein the at least one opening of each panel correspond with the user's mouth.

10. The protective gear of claim 7 wherein the illumination apparatus is releasably attachable to at least one of the outer panel or the inner panel.

11. The protective gear of claim 10 wherein the illumination apparatus includes at least one light.

12. The protective gear of claim 11 wherein the at least one light is attached to the outer panel protruding through an opening of the outer panel from the reverse side of the outer panel through to the obverse side of the outer panel.

13. The protective gear of claim 12 wherein the at least one light is a flashlight.

14. The protective gear of claim 13 wherein a wiring for the at least one light is attached between each element of the at least one two element fastener that attaches the outer panel to the inner panel.

15. The protective gear of claim 14 wherein at least one switch for illuminating the at least one light is attached between the outer panel and the inner panel.

16. The protective gear of claim 15 wherein at least one battery is attached between the outer panel and the inner panel.

17. The protective gear of claim 6 further cormprising:

an illumination apparatus that includes at least one light.

18. The protective gear of claim 17 wherein the at least one light is attached to the outer panel protruding through an opening of the outer panel from the reverse side of the outer panel through to the obverse side of the outer panel.

19. The protective gear of claim 18 wherein at least one switch for illuminating the at least one light is attached between the outer panel and the inner panel.

20. The protective gear of claim 9 further comprising a pocket for the storage of personal items.

* * * * *